US009573713B2

(12) United States Patent
Huber et al.

(10) Patent No.: US 9,573,713 B2
(45) Date of Patent: Feb. 21, 2017

(54) METHOD AND A DEVICE FOR CHANGING CARRIER UNITS WITH FLAT PACKAGING MATERIAL WOUND ON SUPPLY ROLLS WITHIN A PACKAGING MACHINE

(71) Applicant: Krones AG, Neutrabling (DE)

(72) Inventors: Wolfgang Huber, Grafing (DE); Herbert Spindler, Nidermoosen (DE); Thomas Wimmer, Ronseheim (DE)

(73) Assignee: KRONES AG, Neutraubling (DE)

( * ) Notice: Subject to any disclaimer, the term of this patent is extended or adjusted under 35 U.S.C. 154(b) by 188 days.

(21) Appl. No.: 14/503,517

(22) Filed: Oct. 1, 2014

(65) Prior Publication Data

US 2015/0090831 A1 Apr. 2, 2015

(30) Foreign Application Priority Data

Oct. 2, 2013 (DE) ..... 10 2013 110 944

(51) Int. Cl.
*B65H 19/18* (2006.01)
*B65B 21/24* (2006.01)
(Continued)

(52) U.S. Cl.
CPC ..... *B65B 21/245* (2013.01); *B65B 41/12* (2013.01); *B65H 19/12* (2013.01); *B65H 19/123* (2013.01);
(Continued)

(58) Field of Classification Search
CPC ..... B65G 9/004; B65G 9/061; B65B 21/245; B65B 41/12; B65H 19/18; B65H 19/123
See application file for complete search history.

(56) References Cited

U.S. PATENT DOCUMENTS 3,695,539 A * 10/1972 Lindstaedt ..... B65H 16/021 198/432
4,708,300 A * 11/1987 Goetz ..... B65H 19/126 242/551
(Continued)

FOREIGN PATENT DOCUMENTS

CN 101484375 A 7/2009
DE 40 40 545 A1 6/1991
(Continued)

OTHER PUBLICATIONS

Chinese Office action dated Feb. 29, 2016 for CN 2014 105123173.
(Continued)

*Primary Examiner* — Sang Kim
(74) *Attorney, Agent, or Firm* — Dennemeyer & Associates, LLC

(57) ABSTRACT

The invention comprises a method and a device for changing removable carrier units (8*a'*, 8*b'*) with flat packaging material (10) wound on supply rolls (9), in particular, packaging film (11) within a packaging machine (3), which is equipped with devices for at least partially wrapping piece goods, containers, article groups, etc., with flat packaging material (10). With the method removable carrier units (8*a*, 8*b*) with new supply rolls (9) are fed in a series one after the other to a work area (AB) of a handling device (5), the work area (AB) of which extends into at least one position of the operating position of the removable carrier unit (8*a'*, 8*b'*) arranged in the packaging machine (3), which is equipped with a supply roll (9), so that it replaces removable carrier units (8*a'*, 8*b'*) located in the packaging machine (3) and used up supply rolls (9') with new removable carrier units (8*a*, 8*b*) with in each case a new supply roll (9). Here respective removable carrier units (8*a*, 8*b*) are inserted alternately in at least two different installation positions of
(Continued)

the packaging machine (3) and its flat packaging material (10) is connected with the packaging material still located in the packaging machine (3).

10 Claims, 6 Drawing Sheets

(51) Int. Cl.
*B65H 19/12* (2006.01)
*B65B 41/12* (2006.01)

(52) U.S. Cl.
CPC ..... *B65H 19/18* (2013.01); *B65H 19/1831* (2013.01); *B65H 19/1873* (2013.01); *B65H 2301/4172* (2013.01); *B65H 2301/4634* (2013.01); *B65H 2301/46115* (2013.01); *B65H 2801/81* (2013.01)

(56) References Cited

U.S. PATENT DOCUMENTS

| | | | | |
|---|---|---|---|---|
| 4,757,951 | A | 7/1988 | Ludszeweit | |
| 5,205,505 | A * | 4/1993 | Focke | B65B 41/12 242/559.3 |
| 5,209,247 | A | 5/1993 | Rittershaus et al. | |
| 5,219,127 | A | 6/1993 | Boldrini et al. | |
| 5,487,638 | A * | 1/1996 | Salsburg | B65H 19/123 414/626 |
| 5,727,367 | A | 3/1998 | Cahill et al. | |
| 6,355,139 | B1 * | 3/2002 | Baggot | B65H 16/10 162/109 |
| 6,604,704 | B2 * | 8/2003 | Kiprowski | B65H 3/0816 242/559 |
| 7,984,603 | B2 | 7/2011 | Freudenberg et al. | |
| 2004/0140044 | A1 | 7/2004 | Rassi et al. | |
| 2013/0298503 | A1 | 11/2013 | Takahashi et al. | |

FOREIGN PATENT DOCUMENTS

| | | | |
|---|---|---|---|
| DE | 40 18 266 | A1 | 12/1991 |
| DE | 44 36 667 | A1 | 4/1995 |
| DE | 200 12 889 | U1 | 2/2001 |
| DE | 10 2006 017 379 | A1 | 10/2007 |
| EP | 0469298 | A1 | 2/1992 |
| JP | S 57156942 | A | 9/1982 |

OTHER PUBLICATIONS

German Search Report for DE 10 2013 110 944.6 dated Jul. 2, 2014.
European Search Report for EP14 18 5876 dated Mar. 20, 2015.

* cited by examiner

METHOD AND A DEVICE FOR CHANGING CARRIER UNITS WITH FLAT PACKAGING MATERIAL WOUND ON SUPPLY ROLLS WITHIN A PACKAGING MACHINE

The present invention relates to a method as well as to a device for changing carrier units with flat packaging material wound on supply rolls within a packaging machine.

For the processing, compilation, grouping and packaging of articles such as beverage containers there are different types of packaging, for example, the combination of the articles or containers in portable, relatively manageable container units. Various possibilities are also known for combining individual articles in larger containers. Thus, for example, beverage containers are mostly combined and packed by means of shrink films in containers of four, six or more containers. The manufacture of containers is for the most part indispensable, since they represent the most frequent variant of sales units for beverage containers or bottles made of PET plastic. The containers are partially combined again for transport.

In order to provide packaging material for the containers, devices are known from the prior art, which unwind the respective packaging material from one or several rolls and subsequently wrap the containers with the unwound packaging material. The unwinding is sensibly performed by machine, wherein, e.g., the respective packaging material is removed from the roll under rotating movement of the respective roll by means of one or several rollers. If the supply of packaging material of a roll is exhausted, the respective roll can be replaced manually or automatically by a new roll with additional packaging material.

A method and a device for delivering and changing rolls on a production machine is known, for example, from DE 40 40 545 A1. The device comprises several supply rolls with strip material, which are arranged next to each other. If the strip material is to be unwound from one of the rolls, then the respective roll is received by an arm and is moved in a rotating manner to unwind the strip material. A beginning of the strip material is previously connected with a roller, which removes the strip material from the respective roll and guides it away from the device in the downward direction.

If the supply of strip material of the respective roll is exhausted, a new supply roll can be received by the arm and the consumed roll without strip material can be discarded by the arm. Since a threading of a beginning of the respective strip material between two adjacent rollers must occur before receipt of the new roll, the consumed roll must be discarded by the arm and the new roll must be received by the arm before unwinding, a changing process necessarily requires an interruption of the strip unwinding process. For this reason, during the changing process no strip material can be made available, so that a wrapping of the respective article with the strip material is interrupted for a certain period of time. Moreover, each changing process requires a multiplicity of necessary process steps, which requires a complex construction of the device and leads to the extensive implementation of the method.

Accordingly, it is seen as the priority objective of the present invention to make available a device and a method, which is characterized by an increased flexibility in changing the supply rolls. In addition, the method should be implementable in a simple manner and the device should possess an uncomplicated construction.

These objectives are achieved with the subjects of the independent claims. Features of advantageous developments of the invention arise from the dependent claims. Thus, the invention proposes on the one hand a method for achieving the cited objectives, which enables a changing of removable carrier units with flat packaging material wound on supply rolls, in particular, packaging film, within a packaging machine. The packaging machine is equipped with devices for the at least partial wrapping of piece goods, containers, article groups, etc. with packaging film. The devices for the at least partial wrapping of piece goods, containers, article groups, etc. can, for example, possess guide rods, which apply the flat packaging material to the respective piece goods, containers, article groups, etc. It is known to the addressed person skilled in the art how he can develop such devices, so that all conceivable variants are not addressed in the course of the present description.

In the case of the method according to the present invention it is provided that so-called carrier units or removable carrier units with new supply rolls, designed as removable magazines, are fed to a work area of a handling device in a series one after the other. It is conceivable for this that the respective removable carrier units stand on a horizontal conveyor when they are fed to the work area, which extends at least in sections into the work area of the handling device or feeds the respective removable magazines or removable carrier units to the work area of the handling device. The horizontal conveyor can preferably be designed as a conveyor belt and in particular as an endless conveyor belt.

The removable carrier units can stand up on the horizontal conveyor such that they are arranged essentially aligned to the transport direction of the horizontal conveyor. The respective longitudinal axis of the supply rolls of the removable carrier units standing up on the horizontal conveyor can be oriented in particular perpendicular to the transport direction of the horizontal conveyor. Thus, several, preferably, however, all of the new supply rolls of the removable carrier units standing up on the horizontal conveyor and transported there to the machine are oriented parallel to each other and during the transport via the horizontal conveyor maintain their parallel orientation unchanged.

The method according to the present invention makes possible the uninterrupted production of the packaging machine with endlessly fed packaging or film material, since at any point in time an "active" supply roll exists, which is located in the removable carrier unit and is unrolled there. During this unwinding process, which makes possible a certain operating time, in each case the other removable carrier unit, the supply roll of which is unwound, and which is therefore "inactive," can be removed from the packaging machine without any problems and can be replaced by a new removable carrier, in this way brought into readiness, with a full supply roll of packaging material. Due to the—theoretically unlimited—multiplicity of quasi-endlessly feedable removable carrier units, which in each case can be brought one after another into the work area of the handling device, the packaging machine can remain uninterruptedly in use over a very long operating time.

In preferred embodiments of the present invention it can be envisioned that the horizontal conveyor possesses a specific longitudinal extension, so that several—if necessary also a multiplicity of—removable carrier units with supply rolls and flat packaging material can be deposited on the horizontal conveyor and simultaneously stand up on the horizontal conveyor. As a rule, it makes sense to arrange at least three, four, or five such removable carrier units one after the other and to feed the packaging machine in a series, so that at least a certain operating time is made possible without machine interruption.

The horizontal conveyor can here be designed as a buffer system, so that, if necessary, one or several removable carrier units can be deposited manually and/or automatically on the horizontal conveyor and can be stored temporarily when not in use on or by means of the horizontal conveyor. With the formation of the horizontal conveyor as a buffer system several prepared removable carrier units with supply rolls and flat packaging material can be advantageously located on the horizontal conveyor, wherein during a changing process the respective removable carrier units with new supply rolls and flat packaging material can be received by the horizontal conveyor via the handling device.

Here it is conceivable that the horizontal conveyor is operated intermittently, wherein one or several further removable carrier units are fed to the work area of the handling device by means of the horizontal conveyor, after receipt of one or several removable carrier units by the handling device. If a specific or sufficient number of removable carrier units are located in the work area of the handling device, the horizontal conveyor can be at a standstill or can undertake no further feeding of removable carrier units with new supply rolls to the work area of the handling device. The horizontal conveyor can for this purpose be coupled with a control unit, which is in addition connected with the handling device. Suitable algorithms or specifications for the intermittent operation of the horizontal conveyor can be stored on the control unit taking into consideration a receipt of removable carrier units by the handling device. In addition, it is conceivable that the control unit is connected with a discharge device described below in detail and intermittently controls the discharge device taking into consideration a changing process.

It is further provided that a work area of the handling device extends into at least one position of the operating position of the magazine or removable carrier unit equipped with a supply roll, which is arranged in the packaging machine. As mentioned in detail below, at least two different installation positions are provided in the packaging machine for removable carrier units with new supply rolls. The work area can herein be designed such that via the handling device removable carrier units with new supply rolls are usable in all of the at least two installation positions.

For example, the handling device can have a gripper arm for the receipt and for the insertion of removable carrier units into the packaging machine, the extension of which in a radial movement defines the work area of the handling device. In the framework of the present invention that area can be designed as a work area, within which the handling device can receive the removable carrier units and pass them on to the packaging machine or can insert them into the respective installation position of the packaging machine.

For example, it is conceivable that the handling device is arranged between the previously mentioned horizontal conveyor and the respective position of the operating position of the removable carrier unit located in the packaging machine. In preferred embodiments the handling device can be arranged lateral to the respective removable carrier unit located in the packaging machine and by a swiveling movement of the gripper arm cause the insertion of the respective removable carrier unit with new supply roll into the packaging machine.

The work area must also be designed such that the handling device can replace removable carrier units located in the packaging machine and used up supply rolls with respective new removable carrier units with a new supply roll. Thus, it can, for example, be envisaged, that after use of removable carrier units with new supply rolls the respective supply roll of the inserted removable carrier unit is firmly connected with the packaging machine, so that the removable carrier unit can be removed from the packaging machine without the supply roll by the handling device. In preferred embodiments flat packaging material is unwound from the new packaging roll in one process step and in a further and subsequent process step the removable carrier unit or the removable magazine is removed from the packaging machine.

Here it is also conceivable that, when using the removable carrier unit with the new supply roll, the new supply roll is placed on a holding mandrel of the packaging machine. The holding mandrel can be designed such that after use of the removable carrier unit with the new supply roll it enlarges its maximum cross-sectional diameter and thus fixes the new supply roll by clamping. After clamping fixation of the supply roll via the holding mandrel the removable carrier unit can be removed advantageously without the new supply roll. By means of the clamping fixation via the holding mandrel with enlarged maximum cross-sectional diameter a shift or a position change of the new supply roll is prevented during removal of the removable carrier unit.

In particular, embodiments have proven successful, in which after insertion of the removable carrier unit with a new supply roll into the packaging machine initially a partial, but not complete unwinding of the flat packaging material from the new supply roll occurs, before the new supply roll is clamped via the respective holding mandrel or before the respective removable carrier unit of the partially, but not completely unwound supply roll is removed from the packaging machine.

In addition, it is envisaged according to the present invention that respective new removable carrier units are inserted alternately in at least two different installation positions in the packaging machine and their flat packaging material is connected with the packaging material still located in the packaging machine.

Welding processes, particularly welding processes with a welding bar or the like are suitable, for example, for connecting the flat packaging material of new supply rolls with the packaging material located in the packaging machine. In preferred embodiments the flat packaging material of the respective new supply roll is brought into contact with the packaging material located in the packaging machine before connection and before welding. Thus, it can be envisaged, for example, that the packaging machine has two installation positions for one removable carrier unit with a new supply roll, respectively. Thus, a supply roll can be arranged on a first of the two installation positions, from which packaging material is unwound, wherein a new removable carrier unit with new supply roll and packaging material is simultaneously inserted into the second of the installation positions by the handling device.

The method according to the present invention is designed in preferred embodiments such that a supply roll is arranged continuously in at least one of the installation positions, from which flat packaging material is unwound. If a removable carrier unit is arranged in the area of the first installation position or if a removable carrier unit is assigned to the supply roll, from which packaging material is unwound, then a removal of the removable carrier unit from the first installation position can take place. For this purpose, it can sensibly be envisaged that, as already previously mentioned, the supply roll, from which packaging material is unwound, is clamped by a holding mandrel by means of enlargement of its maximum cross-sectional diameter.

After receipt of a removable carrier unit from the installation position the handling device can preferably set down the respective removable carrier unit on a discharge device. The discharge device can also be embodied as a horizontal conveyor. In particular, embodiments are conceivable, in which the discharge device is formed by a conveyor belt or an endless conveyor belt.

If the feeding of removable magazines or removable carrier units with new supply rolls occurs in the work area of the handling device, as already previously mentioned, by means of a horizontal conveyor, then the discharge device can be oriented parallel to it. The transport direction for the removal of magazines can thus run parallel to the transport direction for the feeding of removable carrier units with new supply rolls. For example, the discharge of the magazine can occur in the direction of an equipment section, wherein magazines or removable carrier units discharged in the equipment section are equipped with new supply rolls and are placed on the horizontal conveyor for feeding to the work area of the handling device as removable magazines or removable carrier units with new supply rolls. In the equipment section the preparation of the removable carrier units with new supply rolls can thus occur. The preparation of the respective removable carrier units with new supply rolls can occur automatically and/or manually.

As already previously mentioned, a supply roll can be arranged continuously in at least one of the installation positions, from which flat packaging material is unwound. If a removable carrier unit with new supply roll is inserted in another one of the installation positions, the flat packaging material of the new supply roll can be connected to the flat packaging material of the additional supply roll, from which flat packaging material is unwound.

In preferred embodiments it can be envisaged that the removable carrier units are respectively made available alternately for at least two different installation positions in the packaging machine for the simplified insertion of removable carrier units and for the simplified connection of the respective flat packaging materials, wherein the removable carrier units are prepared for the at least two different installation positions in the packaging machine during feeding to the work area of the handling device.

For this purpose, first removable carrier units can be provided, which are designed for insertion into the first installation position. In addition, second removable carrier units can be provided, which are designed for insertion into the second installation position. First and second removable carrier units can be fed alternately into the work area of the handling device and alternately received by the handling device and are inserted into the installation position provided for the respective first or second removable magazine. If the feeding of removable carrier units occurs via a horizontal conveyor, first and second removable carrier units can be arranged standing up in a series one after the other on the horizontal conveyor as part of the preparation.

New supply rolls of the respective first removable carrier units can be oriented parallel to new supply rolls of the respective second removable carrier units during transport via the horizontal conveyor and/or in the respective installation position. Usefully, first and second magazines or carrier units of the used up supply rolls can be alternately removed from the packaging machine and, if applicable, set down on a discharge device.

If the removable carrier units stand up on a horizontal conveyor during the feeding to the work area of the handling device, the transport direction of the horizontal conveyor can be oriented such that an insertion of the removable carrier units into the respective installation positions can be carried out without a rotation of the removable carrier units and by means of a displacement by the handling device. In particular, the respective removable carrier units with new supply rolls can be lifted for insertion into the respective installation position.

If the discharge of the removable carrier units or magazines with used supply rolls also takes place by means of the horizontal conveyor, the horizontal conveyor can be oriented such that a setting down of the removable carrier units or magazines can occur without rotating on the discharge device designed as a horizontal conveyor.

In particular, embodiments have proven successful, in which the handling device is formed by a multiaxially movable handling robot, which both inserts new removable carrier units into the packaging machine as well as removes used removable carrier units or magazines from the packaging machine.

For this purpose the handling robot can be designed rotatable about a vertically oriented axis. A gripper arm of the handling robot can be raised and lowered about an at least approximately horizontally oriented axis. The gripper arm can consist of two or several parts, which, if applicable, can be pivoted counterclockwise about at least approximately horizontally oriented axes. In addition, the handling robot can have a head, which is designed rotatable and is provided for the receipt of the respective removable carrier units and/or used up supply rolls.

Here it is conceivable that the handling device removes the respective removable carrier unit assigned to the supply roll before a removal of the respective used up supply roll and that, during removal of the removable carrier unit, the respective assigned supply roll possesses at least a remaining stock of flat packaging material. Packaging material can be unwound from the supply roll during the removal of the magazine.

In addition, it is conceivable that the handling device or the handling robot removes a used up supply roll from the packaging machine before the insertion of new removable carrier units. If a supply roll is used up, then no more flat packaging material is stored on the supply roll.

As already previously mentioned, the supply rolls can be placed on a holding mandrel during insertion of the respective removable carrier unit. When the supply roll is removed from the packaging machine the handling device can thus, if necessary, remove the respective roll from the holding mandrel. If the supply roll was fixed on the holding mandrel by enlargement of its maximum cross-sectional diameter, then the fixation can usefully be released before the removal of the supply roll by reducing the maximum cross-sectional diameter of the holding mandrel. To remove the respective used up supply roll from the packaging machine the handling device can possess one or several gripper fingers or the like, which grasp the respective used up supply roll for removal from the packaging machine by clamping.

It is conceivable, for example, that the handling device stores the used up supply roll in a storage container. It can also be envisaged that the handling device passes on the used up supply roll after removal from the packaging machine to one or several transport devices for discharge. After that the used up supply roll can be provided with additional flat packaging material and can again be fed to the work area of the handling device as new supply roll with a corresponding removable magazine or a removable carrier unit. The supply roll can be designed with respect to its geometry as a hollow cylinder and can consist, for example, of plastic or materials with components containing cellulose.

In addition, in preferred embodiments it can be envisaged that a beginning of the flat packaging material of a supply roll of the respective newly inserted renewable carrier units is connected with a section of the flat packaging material guided in the packaging machine under separation of an end of the respective used up supply roll of the respective other removable carrier units, particularly through a welding process by means of a welding bar or the like.

For example, the beginning of the flat packaging material can be applied by a guide element to the flat packaging material guided in the packaging machine, wherein subsequently a welding occurs by means of a welding bar. Here it is conceivable that during or immediately after separation of the end of the respective used up supply roll the beginning of the flat packaging material is applied to the flat packaging material guided in the packaging machine. Here, the guide element can describe a movement which is oriented at least approximately downwards in the vertical direction. In addition, the guide element can make contact with the flat packaging material in its downwards vertical movement. The beginning of the flat packaging material can be guided downwards in the vertical direction and towards the flat packaging material guided in the packaging machine together with the guide element. Preferably the beginning of the flat packaging material is already brought into surface contact with the flat packaging material guided in the packaging machine before the welding. In particular, embodiments have proven successful, in which the guide element in its vertical guidance downwards is brought into contact with the flat packaging material over the entire width of the flat packaging material.

In order to wrap the respective piece goods, containers, article groups, or the like permanently with flat packaging material, particular embodiments have proven successful, in which a removable carrier unit with a used up supply roll of packaging material is removed during an uninterrupted operation of the packaging machine and is replaced by a removable carrier unit with a new supply roll. In order to be able to guarantee an uninterrupted operation, a removable carrier unit with new supply roll must already be inserted into the respective installation position of the packaging machine, before the flat packaging material of a supply roll in another installation position is completely used up or completely unwound. The flat packaging material of the new supply roll can then be connected with the flat packaging material of the other supply roll, preferably by means of welding.

An additional feature of various embodiments of the method according to the present invention can consist in an active carrier element or an active removable carrier unit being located in the packaging machine, the supply roll of which, with packaging material, is unwound while a still inactive removable carrier unit is also already located in the machine, which was placed there beforehand by means of the handling device. If the supply roll of the active removable carrier unit is used up and unwound, a "switching" between the two removable carrier units can occur by welding the packaging material with the beginning of the film of the respective other removable carrier unit, so that the first removable carrier unit with the used up supply roll can be removed from the machine at a suitable point in time, without an interruption of the packaging process having to occur. I.e., the carrier element with the empty supply roll can be removed and transported away from the packaging machine immediately after the welding of the beginning of the supply roll of the respective other carrier element. Since these processes can be repeated almost arbitrarily often in the case of a sufficient supply with a multiplicity of removable carrier units fed one after the other, a quasi-endless operation of the packaging machine is thus made possible, if sufficient new removable carrier units with respective new supply rolls of packaging material are fed to the feeding device. Since the buffer size is basically arbitrarily expandable, an almost arbitrarily long operation time can be predefined and realized for an uninterrupted continuous operation. A further advantage of the carrier element or removable carrier unit used consists in that the handling device or the robot used for this purpose need not directly grasp the supply rolls with the wound-up packaging material. Thus, the part—i.e. the entire removable carrier unit—can be removed and used in the ongoing operation. The clamping rods provided on the removable carrier units, to which the beginning of the belt can be fixed, considerably facilitate the automatic welding of the packaging material or the packaging film, and do so while simultaneously precisely positioning the unwound material. Neither the threading of the beginning of the material nor its manually assisted fixation or welding to the endless material in the machine is required, so that previously required manufacturing and handling steps can be dispensed with.

In various embodiments it can be envisaged that a removal of a cassette as well as an empty supply roll from the packaging machine occurs at least approximately at the same time and in one process step. In especially preferred embodiments, however, as already previously described in detail, it is envisaged that empty supply rolls as well as cassettes are removed from the packaging machine in separate and successive process steps.

In addition, the present invention relates to a device for changing removable carrier units with flat packaging material wound on supply rolls, in particular packaging film, within a packaging machine. Here it should be mentioned that all previously described features, which can be provided for implementing the method according to the present invention, can also be used in various embodiments of the device according to the present invention. Likewise, all features, which are described below for various embodiments of the device according to the present invention, can be used in additional embodiments of the method according to the present method.

The packaging machine is equipped with devices for the at least partial wrapping of piece goods, containers, article groups, etc. with packaging film.

The device according to the present invention comprises a feeding device for the provision of removable magazines or removable carrier units with new supply rolls in a series one after the other, which is assigned to a work area of a handling device. As already previously mentioned, in preferred embodiments of the present invention, the feeding device is formed by one or several horizontal conveyors, which guide the respective removable carrier units with new supply rolls into the work area of the handling device. In particular, embodiments are suitable with the formation of one or several horizontal conveyors by one or several endless conveyor belts. The one or several horizontal conveyors designed as a feeding device thus extend, if necessary, at least in sections into the work area of the handling device. In various embodiments more than one handling device can also be used. In practice, however, it has been shown that in preferred embodiments one handling device can suffice, in order to insert removable carrier units with new supply rolls alternately into the respective installation position.

In particular, if the feeding device is formed by one or several horizontal conveyors, the one or several horizontal conveyors may be operated in a synchronized manner or intermittently. For example, it can be envisaged that one or several additional removable carrier units are guided into the work area of the handling device by means of the feeding device or by means of one or several horizontal conveyors after receipt of one or several removable carrier units by the handling device, so that at least one removable carrier unit is continuously provided by the feeding device for the work area of the feeding device.

The feeding device or the one or several horizontal conveyors can be designed here as a buffer system, which stores several removable carrier units with new supply rolls and provides the handling device as required with the respective removable carrier units.

The work area of the handling device extends into at least one position of the operating position of the removable carrier unit arranged in the packaging machine, which is equipped with a supply roll. In addition, the work area is designed such that the new removable carrier units can be inserted at the different installation positions into the device by means of the handling device.

In the device according to the present invention it is also envisaged that respective new removable carrier units with the respective new supply roll can be inserted alternately at at least two different installation positions in the packaging machine and the flat packaging material of which can be connected to the packaging material still located in the packaging machine. For example, it is conceivable that two installation positions are provided for removable carrier units and supply rolls, wherein in the available supply rolls in both of the installation positions the supply roll of the first installation position has a parallel orientation to the supply roll of the second installation position.

Preferably it can be envisaged that the removable carrier units are prepared at the latest upon entry into the work area of the handling device for the respective at least two different installation positions in the packaging machine. Thus, one prepared removable carrier unit can be assigned a new supply roll. In addition, a prepared removable carrier unit can be characterized by a certain orientation to the feeding device, so that it can be removed from the feeding device by means of the handling device and can be inserted into the respective installation position without rotation.

In preferred embodiments the removable carrier units can respectively be formed by cassettes, which have a frame, which is designed for the supportive holding of the respective new supply roll and its flat packaging material. For example, the frame can have at least two support rods extending respectively parallel to the respective new supply roll, on which the respective new supply roll rests. The respective longitudinal extension of the at least two support rods can correspond at least to the longitudinal extension of the supply roll, however, preferably be embodied approximately identical to the longitudinal extension of the supply roll.

In addition, the removable carrier units, the removable magazines, or the cassettes have at least on one side one or several bore holes, into which the handling device dips to receive the respective removable carrier units with correspondingly designed gripper fingers. It is also conceivable that the removable carrier units form a lateral block for the respective new supply roll, at which the respective new supply roll lines up. The respective new supply roll of the respective removable carrier unit or the respective cassette can be held by the block in a predefined position. A lateral shift of the respective new supply roll from the respective removable magazine or from the respective cassette or respective removable carrier unit is prevented by the lateral block. The respective removable carrier units or the respective cassettes can, for example, be formed by plastic and/or metal.

In addition, it can be envisaged that the cassettes or removable carrier units respectively possess a supporting bar extending parallel to the supply roll, which prior to connection with the packaging material located in the packaging machine carries a beginning of the flat packaging material wound on the new supply roll of the respective cassette. If the respective removable carrier unit also possesses at least two support rods for carrying the new supply roll, the at least two support rods and the supporting bar can extend parallel to each other.

In preferred embodiments it can be envisaged that at least one first installation position is provided for first removable carrier units and at least one second installation position for second removable carrier units. Here the first removable carrier units can have one supporting bar, which is arranged on a first side of the removable carrier unit, while the second removable carrier units have a supporting bar, which is arranged on a second side of the removable carrier unit, wherein with regard to the feeding of the first and the second removable carrier units to the work area of the handling device the first side is opposite the second side.

Furthermore, it can be envisaged that in the first removable carrier units the flat packaging material of the respective new supply rolls is guided upwards in the direction of the supporting bar, while in the second removable carrier unit the flat packaging material of the respective new supply roll is guided downwards in the direction of the supporting bar.

In various embodiments the flat packaging material, which is provided for the at least partial wrapping of piece goods, containers, article groups, etc., can have optical markings, so that a connection to defined positions of the flat packaging material of the new supply rolls with the packaging material still located in the packaging machine is necessary.

Embodiments have proven successful for this, in which the supporting bars of the cassettes are designed rotatably, so that flat packaging material of the respective new supply roll can be wound on the supporting bar of the respective cassette. A winding of the respective flat packaging material can occur such that the respective flat packaging material is aligned for the connection or defined positions can be set for the connection of the flat packaging material with the packaging material still located in the packaging machine by winding.

The winding of the flat packaging material on the respective supporting bar can occur during or in the course of the preparation of the removable carrier units and thus prior to entry of the removable carrier units into the work area of the handling device. Here is it conceivable that the winding is undertaken manually and/or automatically.

In particular, embodiments have proven successful, in which the packaging machine has at least one first installation position for first removable carrier units and has at least one second installation position for second removable carrier units. The supporting bars of the first removable carrier units and the second removable carrier units can be arranged on opposite sides, so that the supporting bars of the first removable carrier units when inserted into the first installation position point in the direction of the second installation position and the supporting bars of the second removable carrier units when inserted into the second installation position point in the direction of the first installation position.

As already previously mentioned, the beginning of the flat packaging material of a new supply roll can be applied to the flat packaging material guided in the packaging machine by a guide element, in which case a welding subsequently takes place by means of the welding bar. The respective supporting bars in the case of a removable carrier unit inserted in the respective installation position can direct the flat packaging material of the new supply roll beneath the guide element to the guide element. Through a downwards vertical movement of the guide element the flat packaging material of the new supply roll can then be applied to the packaging material still located in the packaging machine and subsequently, preferably by means of welding, can be connected to the packaging material still located in the packaging machine.

In the case of a device according to the present invention when the respective removable carrier unit is inserted into the respective installation position the respective new supply roll can be placed on a holding mandrel, so that by means of enlarging its cross-sectional diameter the respective supply roll can be fixed on the holding mandrel by means of clamping.

Also, in the framework of the device according to the present invention the handling device can be formed by a multiaxially movable handling robot, which both inserts new removable carrier units into the packaging machine as well as removes used removable carrier units with empty supply rolls from it. As already previously mentioned, the handling robot can be designed rotatable about a vertical axis as well as possess a gripper arm, which is designed pivotable about one or several horizontally oriented axes.

If a discharge device is provided for carrier units removed by the handling device from the packaging machine, the discharge device can be formed by one or several horizontal conveyors, in particular by endless conveyor belts.

In the following, embodiments should explain in detail the invention and its advantages by means of the attached figures. The proportions of the individual elements in relation to each other in the figures does not always correspond to the real proportions, since some forms are simplified and other forms are enlarged in proportion to other elements for better illustration.

For similar or similarly operating elements of the invention identical reference signs are used. Furthermore, for the sake of providing an overview only reference signs are presented in the individual figures, which are required for the description of the respective figure. The embodiments depicted constitute only examples of how the device according the present invention or the method according to the present invention can be arranged and do not represent a final limitation.

Figure 1:
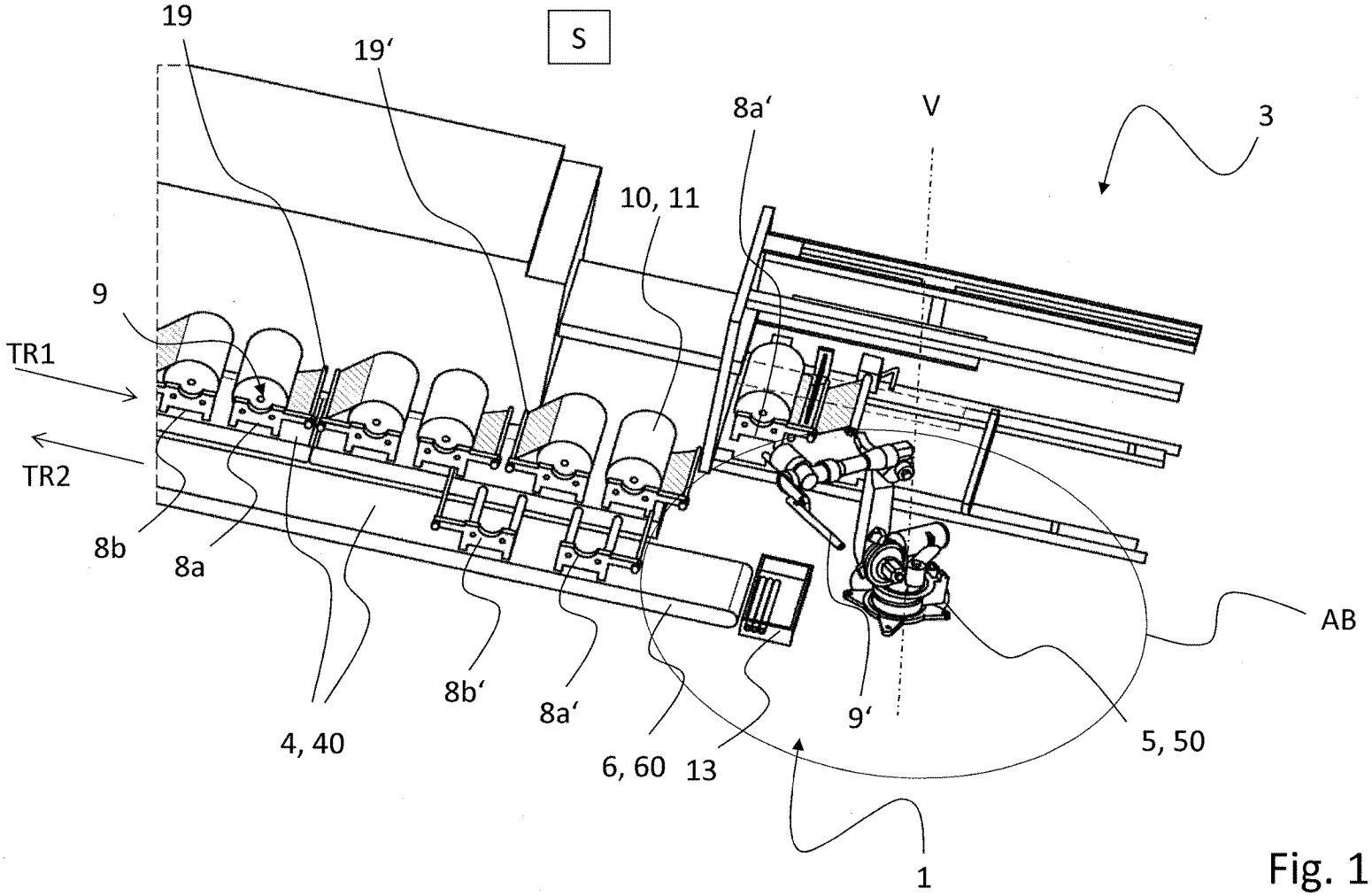
FIG. 1 shows a schematic perspective view of an embodiment for a device according to the present invention for changing removable carrier units.

The schematic perspective view of FIG. 1 shows an embodiment of a device 1 according to the present invention for changing removable carrier units 8*a*' or 8*b*'. As part of the method the removable carrier units 8*a*' or 8*b*' are removed from the packaging machine 3 and replaced by removable carrier units 8*a* and 8*b* with new supply rolls 9. Packaging material 10, in the present case packaging film 11, is wound up and stored on the new supply rolls 9.

The packaging machine 3 comprises in practice several devices, which are designed for wrapping articles with the flat packaging material 11. For reasons of clarity the devices are not depicted in the figures of the present patent application.

As can be seen from FIG. 1, removable carrier units 8*a* and 8*b* with in each case a new supply roll 9, on which packaging film 11 is stored, are guided one after the other on a feeding device 4, which is designed as a horizontal conveyor 40, in the transport direction TR1 or fed to the packaging machine 3. The new supply rolls 9 are oriented here parallel to each other and aligned such that their respective longitudinal axis runs perpendicular to the transport direction TR1 of the horizontal conveyor 40.

In addition, a handling device 5 is depicted, which is designed as a multi-axial movable handling robot 50 and possesses a work area AB, within which it can remove removable carrier units 8*a* and 8*b* from the horizontal conveyor 40 and can insert the respective removable carrier units 8*a* and 8*b* into one of the assigned installation positions EB1 or EB2 (see FIG. 4) of the packaging machine 3. If supply rolls 9 are located in both of the installation positions EB1 and EB2, then the supply rolls 9 can have a parallel orientation to each other.

The feeding device 4 or the horizontal conveyor 40 extends into the work area AB of the handling device 5 and conveys removable carrier units 8*a* or 8*b* one after another into the work area AB.

As can be seen in FIG. 1, several removable carrier units 8*a* and 8*b*, which are not located in the work area AB, stand up with their undersides in each case on the horizontal conveyor 40. Thus, the horizontal conveyor 40 is designed as a buffer system. If the handling device 5 or the handling robot 50 receives one or several removable carrier units 8*a* or 8*b* from the horizontal conveyor 40 for a changing process, the corresponding number of removable carrier units 8*a* or 8*b* can be carried on to the work area AB of the handling robot 50 by the horizontal conveyor 40. Since the horizontal conveyor 40 in the present case carries removal carrier units 8*a* or 8*b* with new supply rolls 9 on to the work area AB of the handling device 5 only as required, it is operated intermittently. The respective feeding of removable carrier units 8*a* or 8*b* to the work area AB or the intermittent operation of the horizontal conveyor 40 can be preset via a control unit S, which in addition is coupled to the handling device 5 or to the handling robot 50. Thus, the horizontal conveyor 40, for example, when a removable carrier unit 8*a* or 8*b* is received by the handling device 5, can at least approximately at the same time carry an additional removable carrier unit 8*a* or 8*b* on to the work area AB. In the present case the discharge device 6, which is subsequently described in detail, is also coupled to the control unit S for the intermittent operation and for the discharge of removable carrier units 8*a*' and 8*b*'.

In addition, FIG. 1 shows that the work area AB of the handling device 5 extends into a position of the operating position of the removable carrier unit 8*a*' arranged in the packaging machine 3, which is equipped with a supply roll 9. As shown in detail in FIG. 4, the packaging machine 3 possesses a second installation position EB2, in which a removable carrier unit 8*b*' with supply roll 9 can also be inserted. The working area AB also extends into the operating position of the removable carrier unit 8*b*' of the second installation position EB2. Thus, removable carrier units 8*a* or 8*b* can be inserted into their respective installation positions EB1 or EB2 via the handling device 5 (see FIG. 4).

In order to be able to receive the respective removable carrier units 8*a* or 8*b* from the horizontal conveyor 40 and to insert them into the respective installation position EB1 or EB2, the handling device 5 designed as a handling robot 50 is rotatable about a vertical axis V. The freedom of movement of an exemplary handling device 5, as it is also used in FIG. 1, is depicted and described in detail in FIG. 7.

In addition, the work area AB of the handling device 5 is designed such that the handling device 5 can remove used up supply rolls 9' without packaging film 11 from the packaging machine 3. FIG. 1 shows here a process step, in which a used up supply roll 9' without packaging film 11 was already removed from the packaging machine 3 and is carried by the handling device 5. Within the work area AB of the handling device 5 a storage module 13 is arranged, in which the handling device 5 puts down the used up supply roll 9'. The used up supply rolls 9' are recyclable, so that packaging film 11 can be stored again on the used up supply role 9' and the used up supply roll 9' can be reassigned as supply roll 9 to a removable carrier unit 8*a* or 8*b* with additional packaging film 11 or with additional packaging material 10.

If a removable carrier unit 8*a* or 8*b* with new supply roll 9 is inserted into the respective installation position EB1 or EB2 of the packaging machine 3, then the new supply roll 9 is placed on a holding mandrel 15 or 15' (see FIG. 4) and firmly connected by clamping to the holding mandrel 15 or 15'. In addition, the packaging film 11 is connected with packaging film 11' still remaining in the packaging machine 3 or with packaging material 10' (see FIG. 4) still remaining in the packaging machine 3. The connection occurs by means of welding of both packaging films 11 and 11'.

After a certain share of packaging film 11 has been unwound from the new supply roll 9 in the packaging machine 3, the respective new supply roll 9 is no longer in surface contact with the respective removable carrier unit 8*a*' or 8*b*'. After that the respective removable carrier unit 8*a*' or 8*b*' assigned to the new supply roll 9 can be removed by the handling device 5 from the packaging machine 3. Advantageously, the new supply roll 9 is here fixed via the respective holding mandrel 15 or 15' shown in FIG. 4, so that in addition a shift of the supply roll 9 on the holding mandrel 15 or 15' can be excluded by the clamping.

Since the work area AB of the handling device 5 extends into the positions of the operation position of removable carrier units 8*a*' or 8*b*', the handling device 5 or the handling robot 50 can remove removable carrier units 8*a*' or 8*b*' from the packaging machine 3. If a removable carrier unit 8*a*' or 8*b*' was removed from the packaging machine 3, then the respective removable carrier unit 8*a*' or 8*b*' can be put down by the handling device 5 on the discharge device 6 or on the horizontal conveyor 60.

The discharge device 6 or the horizontal conveyor 60 possesses a transport direction TR2 for the removable carrier units 8*a*' or 8*b*', which runs parallel to the transport direction of the feeding device 6 designed as a horizontal conveyor 60. The discharge device 6 leads the removable carrier units 8*a*' or 8*b*' in the direction of an equipment section 17 (see FIG. 2), in which removable carrier units 8*a* and 8*b* are prepared with new supply rolls 9.

As can be seen in FIG. 1, first removable carrier unit 8*a* and second removable carrier unit 8*b* are transported on the feeding device 4. The first removable carrier units 8*a* are provided in order to be inserted in the first installation position EB1. The second removable carrier units are provided in order to be inserted into the second installation position EB2. Since the insertion of removable carrier units 8*a* or 8*b* with respective supply rolls 9 into the first installation position EB1 and into the second installation position EB2 occurs alternately, first removable carrier units 8*a* and second removable carrier units 8*b* are also arranged alternately on the horizontal conveyor 40. The handling device 5 can thus receive the removable carrier units 8*a* and 8*b* arranged in each case right at the front on the horizontal conveyor 40 and inserted into the respective installation position EB1 or EB2. Through the prepared first and second removable carrier units 8*a* and 8*b* on the horizontal conveyor 40 in alternating arrangement a complex sensor can be dispensed with for differentiating between first and second removable carrier unit 8*a* and 8*b* for the respective receipt by the handling device 5. Thus, the first removable carrier units 8*a* and the second removable carrier units 8*b* are already prepared by the alternating arrangement on the horizontal conveyor 40 during the feeding to the work area AB for the insertion into the respective installation position EB1 or EB2. In addition, the removable carrier units 8*a* and 8*b* are pre-oriented on the horizontal conveyor 40, so that the handling device 5 can receive the removable carrier units 8*a* and 8*b* and can insert the removable carrier units 8*a* and 8*b* into the respective installation position EB1 or EB2 without rotation.

Figure 4:
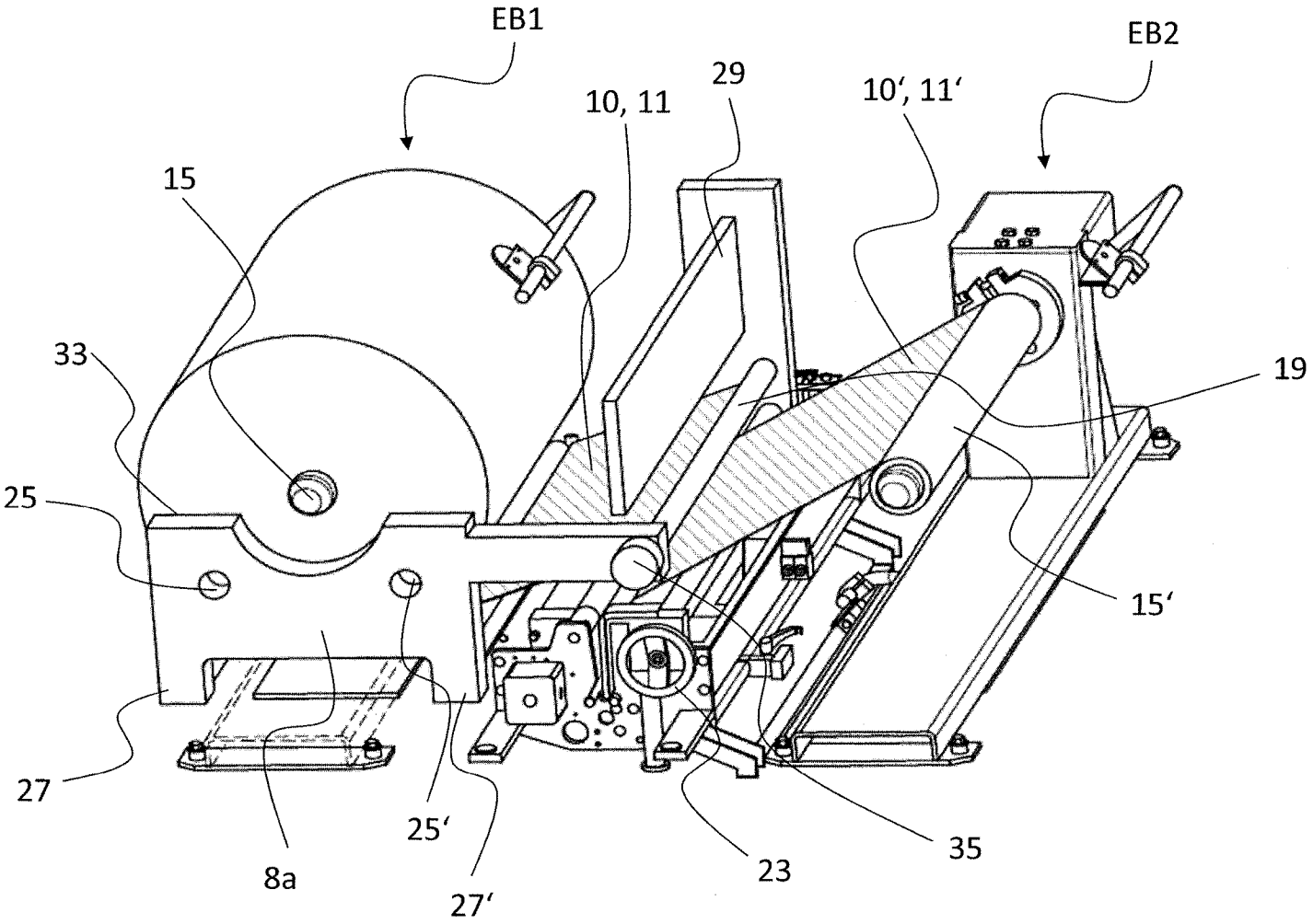
FIG. 4 shows in detail a part of the device for changing removable carrier units from the embodiment of FIGS. 1 to 3.

As can also be clearly seen in FIG. 4, the first removable carrier units 8*a* and the second removable carrier units 8*b* in each case possess a supporting bar 19 or 19'. The supporting bar 19 of the first removable carrier units 8*a* is here arranged on a first side of the first removable carrier unit 8*a*, while the supporting bar 19' of the second removable carrier unit 8*b* is arranged on a second side of the second removable carrier unit 8*b*. If first removable carrier units 8*a* and second removable carrier units 8*b* are received by the handling device 5 and inserted into the respective installation position EB1 or EB2, then with regard to the feeding of the first and the second removable carrier units 8*a* and 8*b* the first side is opposite to the second side. Also, in feeding the removable carrier units 8*a* and 8*b* on the horizontal conveyor 40 to the work area AB, the supporting bar 19 or 19' of the first removable carrier units 8*a* and the second removable carrier units 8*b* are located on opposite sides. The removable carrier units 8*a* and 8*b* are thus prepared on the horizontal conveyor 40 with regard to their alignment for insertion into the respective installation position EB1 or EB2.

Since the removal of first and second removable carrier units 8*a*' or 8*b*' from the packaging machine 3 also occurs alternately, the removable carrier units 8*a*' or 8*b*' are also arranged alternately on the discharge device 6 or the removable carrier units 8*a*' or 8*b*' are transported away alternately by the discharge device 6.

Figure 2:
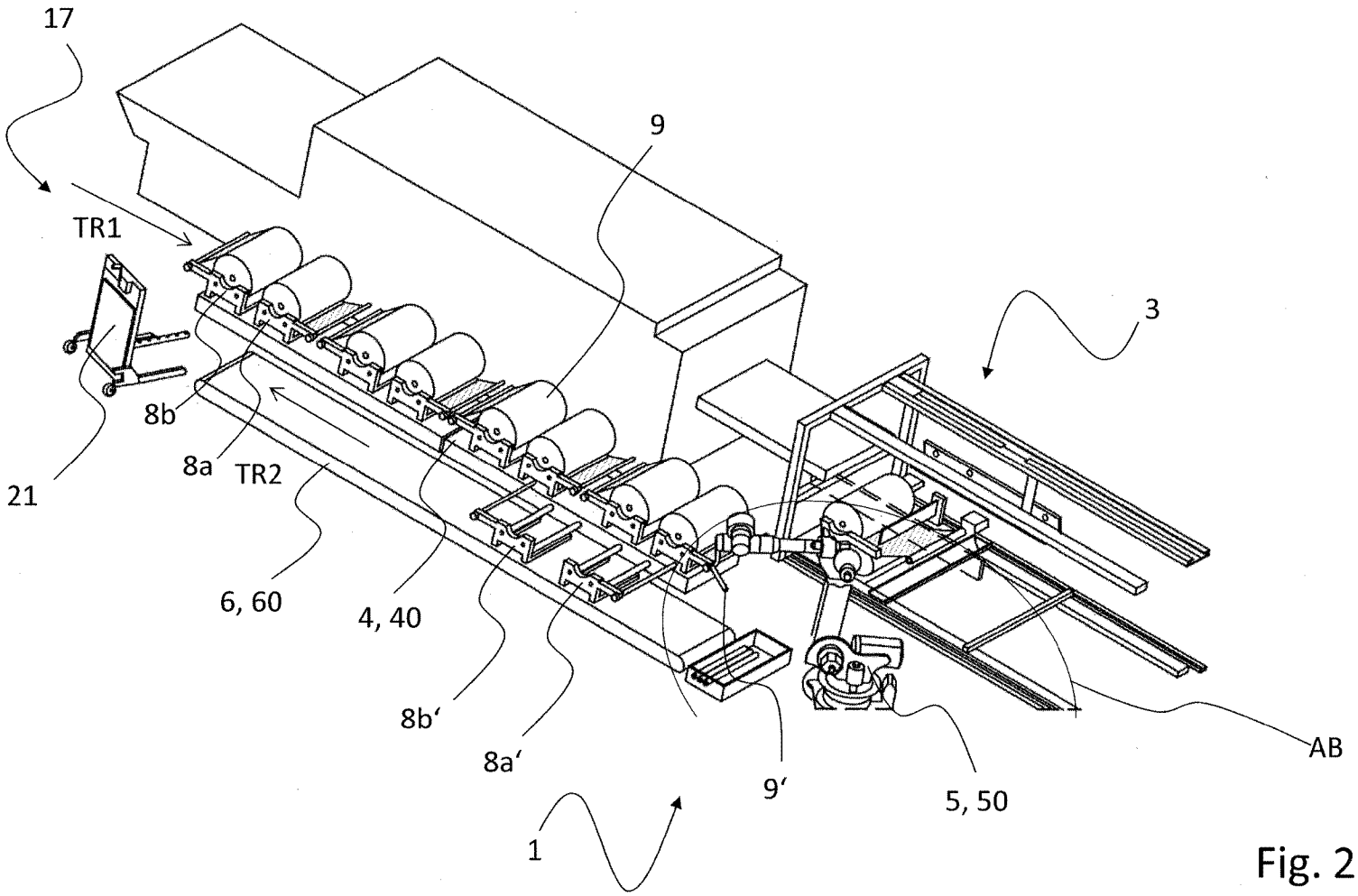
FIG. 2 shows an additional schematic perspective view of the device from FIG. 1.

FIG. 2 shows a further schematic perspective view of device 1 from FIG. 1 as well as the packaging machine 3. In FIG. 2 an equipment section 17 can clearly be seen, in which removable carrier units 8*a*' and 8*b*' are received, equipped with a new supply roll 9 and are moved as removable carrier units 8*a* and 8*b* on the feeding device 4 or the horizontal conveyor 40 in the direction of the work area AB. In the present case a manually operable preparatory instrument 21 is provided for this. In other embodiments, however, it is also conceivable that the removable carrier units 8*a* and 8*b* are automatically formed with their respectively new supply roll 9 and are put down on the feeding device 4 or the horizontal conveyor 40. In addition, FIG. 2 shows that the transport of the removable carrier units 8*a* and 8*b* by the horizontal conveyor 40 begins in the equipment section 17, while the transport of removable carrier units 8*a*' and 8*b*' via the discharge device 6 ends in the equipment section 17. The transport direction TR1 of the feeding device 4 and the transport direction TR2 of the discharge device 6 are continuously oriented parallel to each other.

Figure 3:
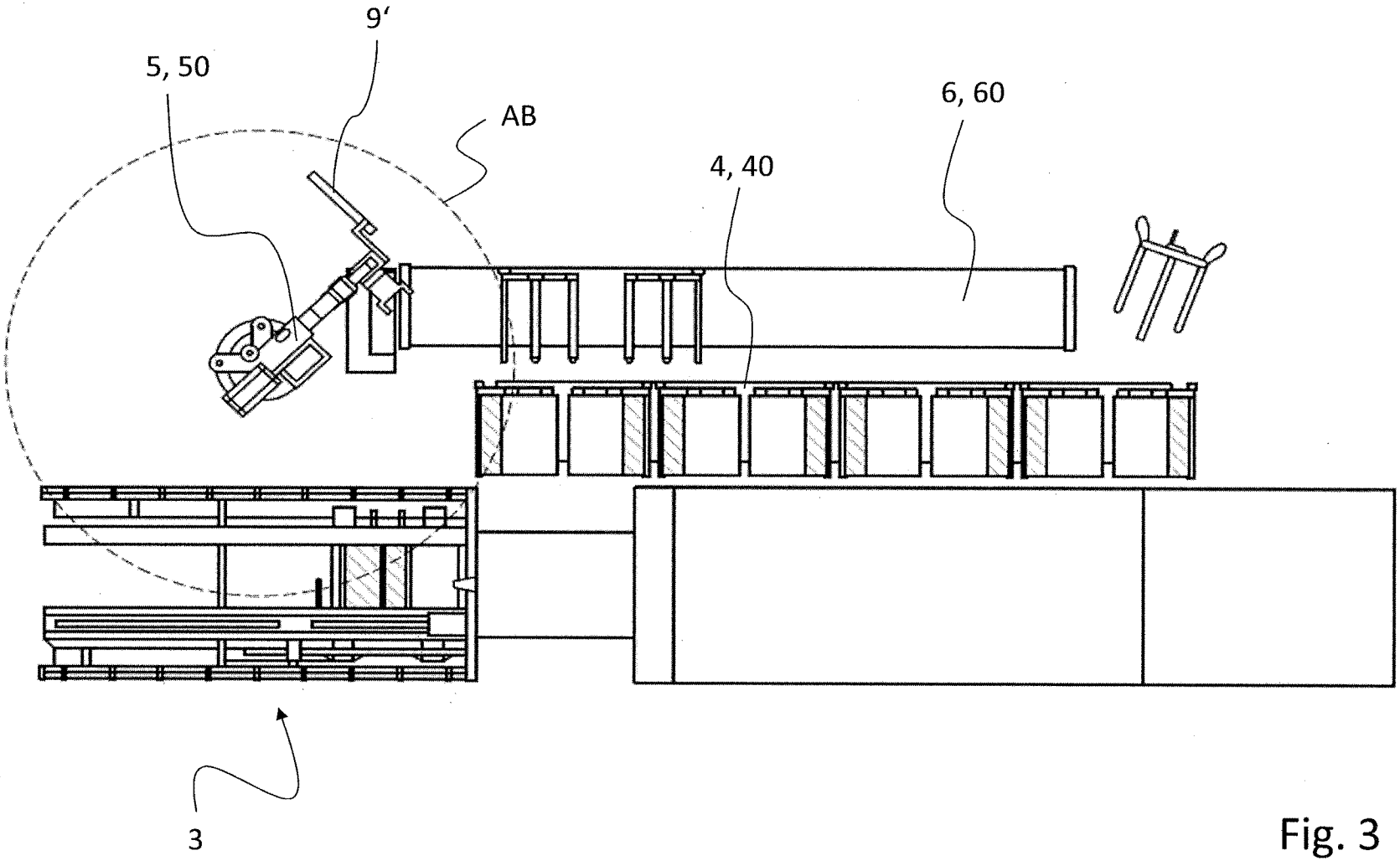
FIG. 3 shows a schematic top view of the embodiment of a device for changing magazines from FIGS. 1 and 2.

In addition, a schematic top view of the embodiment of a device 1 from FIGS. 1 and 2 is depicted in FIG. 3. Once again a possible formation of the work area AB of the handling device 5 or the handling robot 50 can be clearly seen in FIG. 3, which work area AB extends radially about a rotational axis V (see FIG. 1) of the handling device 5. It is clear to the person skilled in the art addressed on the subject, that the dimensioning as well as the position of the work area AB in the figures of the present patent application should be understood merely as exemplary. In practice, the work area can also have larger or smaller dimensionings, in order to receive the respective removable carrier units 8*a* and 8*b* from the feeding device 4 and to be able to insert into the respective installation position EB1 or EB2 or in order to remove the respective removable carrier units 8*a*' and 8*b*' from the packaging machine 3 with the used up supply rolls 9'.

FIG. 4 shows in detail a part of the device 1 from the embodiment of FIGS. 1 to 3. In FIG. 4 the installation positions EB1 and EB2 of the packaging machine 3 can now be seen. The first installation position EB1 is provided exclusively for the insertion of first removable carrier units 8*a* with new supply rolls 9, while the second installation position EB2 is provided exclusively for the insertion of second removable carrier units 8*b* with new supply rolls 9. Removable carrier units 8*a* or 8*b* are inserted alternately into the installation positions EB1 and EB2 with new supply rolls 9.

After insertion of the respective removable carrier units 8*a* or 8*b* with new supply rolls 9 a holding mandrel 15 or 15' grasps through the respective supply roll 9 which cannot be seen in FIG. 4. The holding mandrel 15 of the first installation position EB1 is oriented parallel to the holding mandrel 15' of the second installation position EB2.

In addition, FIG. 4 shows a guide element 29, which is designed vertically movable for connecting the packaging film 11 with the packaging film 11' still remaining in the packaging machine 3. If only a little or no packaging film 11 is arranged on the supply roll 9 of an installation position EB1 or EB2, the guide element 29 is lowered vertically, wherein the packaging film 11 is applied to the packaging film 11' remaining in the packaging machine 3 or to the flat packaging material 10' remaining in the packaging machine 3. In FIG. 4, a removable carrier unit 8*a* with new supply roll 9 was inserted into the first installation position EB1, so that during the vertical lowering of the guide element 29 the packaging film 11 of the new supply roll 9 is applied to the packaging film 11' sill remaining in the packaging machine 3 or to the packaging film 11' of a supply roll 9 arranged in the second installation position EB2. The guide element 29 is designed such that it is brought into contact with the packaging film 11 in its vertical guidance downwards over the entire width of the packaging film 11.

In addition, the reference number 23 refers to an actuating element for a welding bar not depicted in FIG. 4. By means of the actuating element 23 a welding bar can, for example, be moved horizontally and a welding of the packaging films 11 and 11' undertaken. The welding occurs, after the guide element 29 has brought the packaging films 11 and 11' in contact with each other. Since uninterruptible packaging film 11 or 11' is removed from supply rolls 9, in the present case the supply roll 9 of the first installation position EB1 is set into rotating motion immediately after welding. Here the quantity of the packaging film 11 stored on the supply roll 9 of the first installation position EB1 decreases, wherein the supply roll 9 with its packaging film 11 loses contact with the removable carrier unit 8*a*.

By means of an enlargement of the cross-sectional diameter of the holding mandrel 15 the supply roll 9 can be held by clamping in the first installation position EB1, whereupon the removable carrier unit 8*a* or the magazine 8*a*' is removed from the first installation position EB1 and is set down on the discharge device 6 by means of the handling device 5 or the handling robot 50 (see FIGS. 1 to 3). The removal occurs preferably after the supply roll 9 with its decreasing packaging film 11 has lost contact with the removable carrier unit 8*a*.

After the packaging film 11' was separated from the supply roll 9 arranged in the second installation position EB2 and after the removable carrier unit 8*a* or the magazine 8*a*' was removed from the first installation position EB1, by means of the handling device 5 the supply roll 9 of the second installation position EB2 was removed from the holding mandrel 15' and by means of the handling device 5 set down in a storage module 13 (see FIG. 1). If a clamping connection exists between the holding mandrel 15' and the supply roll 9, this clamping connection must be previously released.

A second removable carrier unit 8*b* with new supply roll 9 can then be placed by means of the handling device 5 into the second installation position EB2. The insertion of a removable carrier unit 8*a* or 8*b* thus occurs, while packaging film 11 or 11' is unwound from a supply roll 9 of the first installation position EB1 or the second installation position EB2. Thus, during the uninterrupted operation of the packaging machine 3 a supply roll 9 is arranged permanently at one of the two installation positions EB1 or EB2, from which packaging film 11 or 11' is unwound.

The removable carrier units 8*a* and 8*b* are in each case designed as cassettes, which have a frame, which is designed for supportive holding of the respective new supply roll 9 and its packaging film 11. The frame has two bore holes 25 and 25', into which gripper fingers 31 (see FIG. 6) of the handling device 5 or the handling robot 50 intervene to receive the removable carrier unit 8*a* or 8*b* from the feeding device 4. If the respective removable carrier unit 8*a* or 8*b* was inserted into the respective installation position EB1 or EB2, the gripper fingers 50 can leave the bore holes 25 and 25'.

In addition, the removable carrier units 8*a* and 8*b* possess in each case main pillars 27 and 27', by means of which they stand up on the feeding device 4 or on the horizontal conveyor 40 as well as on the packaging machine 3 in the respective installation position EB1 or EB2. Furthermore, in each case they possess a block 33, at which the respective supply roll 9 lines up via its packaging film 11 on the respective removable carrier unit 8*a* or 8*b*. Advantageously the respective supply roll 9 can be held laterally via the block, so that a lateral slipping of the supply roll 9 off of the removable carrier unit 8*a* or 8*b* is prevented particularly during insertion into the respective installation position EB1 or EB2.

In addition, the supporting bar 19 is depicted, which carries a beginning of the packaging film 11 before vertical lowering of the guide element 29. If the removable carrier unit 8*a* or 8*b* is located in the respective installation position EB1 or EB2, the supporting bar 19 or 19' is oriented parallel to the holding mandrel 15 or 15'. The supporting bar 19 or 19' is connected to a wheel 35, via which the supporting bar 19 or 19' can be moved in a rotary manner. With rotation of the supporting bar 19 or 19' the packaging film 11 is wound up on the supporting bar 19 or 19'.

If the packaging film 11 has optical markings, a connection to the packaging film 11' still remaining in the packaging machine 3 at defined locations can be desirable. For the position specification for the welding the packaging film is wound up via the wheel 35 on the supporting bar 19. In the present case the wheel 35 is actuated manually, in other embodiments an actuation by machine is conceivable with position specification of the packaging film 11 or of the packaging material 10 for the welding. Advantageously the position specification of the packaging film 11 for the welding already occurs before placing the respective removable carrier unit 8*a* or 8*b* on the feeding device 4, however, at latest before the entry of the respective removable carrier unit 8*a* or 8*b* in the work area AB (see FIGS. 1 to 3) of the handling device 5 or the handling robot 50.

In the first removable carrier units 8*a*, as shown in FIG. 4, the flat packaging material 10 or the packaging film 11 points away from the supporting bar 19 and diagonally downwards. In the second removable carrier units 8*b*, contrary to this, the flat packaging material 10 or the packaging film 11 points away from the supporting bar 19 and diagonally upwards.

In addition, the supporting bars 19 or 19' pass by the flat packaging material 10 or the packaging film 11 underneath the guide element 29 on the guide element 29, so that by means of its vertical movement downwards the guide element 29 can come into contact with the respective packaging film 11 and for the purpose of its welding guide the packaging film 11 with the guide element 29 downwards and towards the packaging film 11' still remaining in the packaging machine 3 or towards the flat packaging material 10 still remaining in the packaging machine 3.

Figure 5:
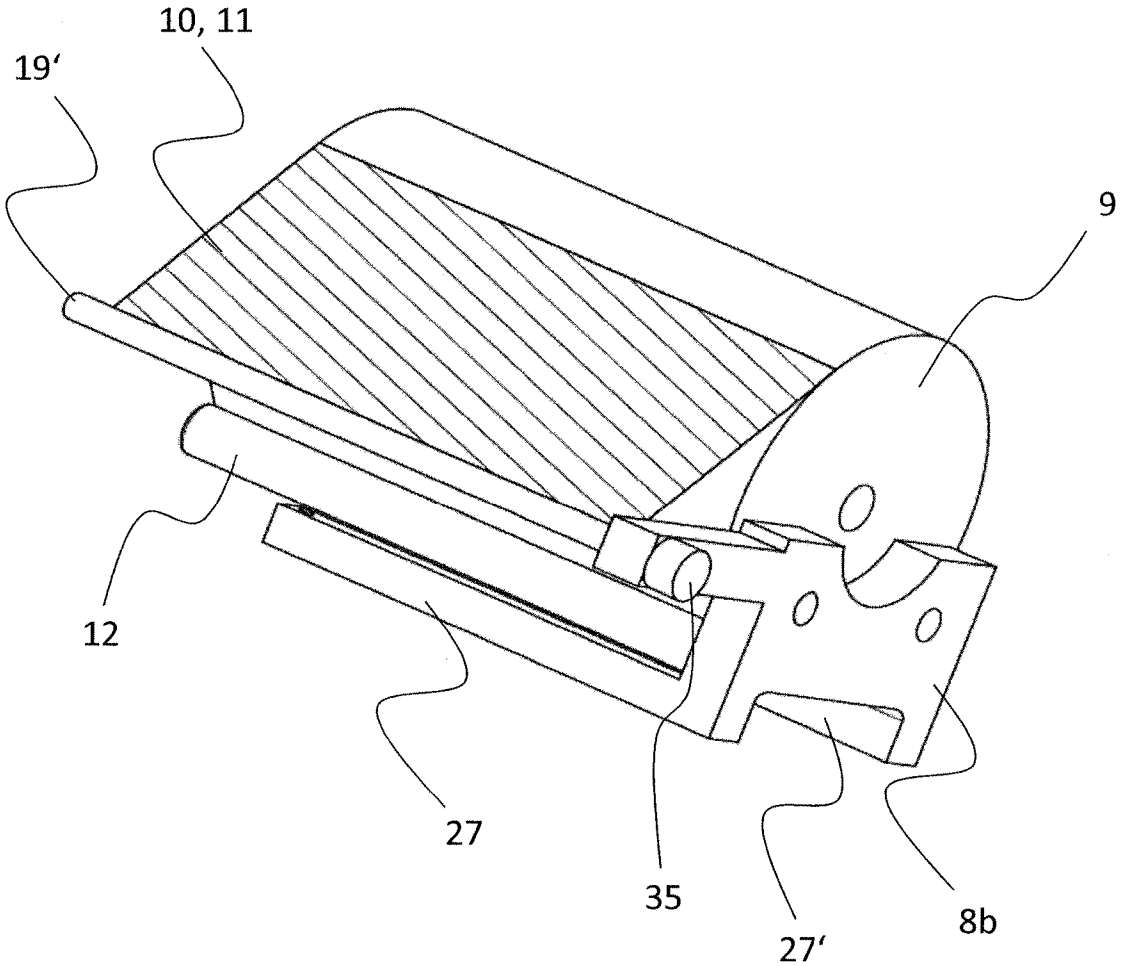
FIG. 5 shows a schematic perspective view of a removable carrier unit with new supply rolls, as they can be used for diverse embodiments of the present invention.

FIG. 5 shows a schematic perspective view of a removable carrier unit 8*b* with new supply roll 9, as they can be used for diverse embodiments of the present invention.

Analogous to FIG. 4, FIG. 5 again shows the two main pillars 27 and 27' of the removable carrier unit 8*b* as well as the supporting bar 19'. The second removable carrier unit 8*b* depicted in FIG. 5 is provided for insertion into the second installation position EB2 of the packaging machine 3. For this reason, the flat packaging material 19 or the packaging film 11 points away from the supporting bar 19' and diagonally upwards. In addition, the supporting bar 19' of the second removable magazine from FIG. 5 is arranged on a side opposite to the supporting bar 19 depicted in FIG. 4 of the first removable carrier unit 8*a*.

In addition, FIG. 5 shows one support rod 12, of which the removable carrier units 8*a* or 8*b* in each case have two and by means of which the respective new supply roll 9 is carried. The support rods 12 extend here parallel to the respective supporting bar 19 or 19' and have a longitudinal extension, which is designed at least approximately identical to the longitudinal extension of the supply rolls 9. In addition, the respective supply rolls 9 are oriented parallel to the support rods 12.

Figure 6:
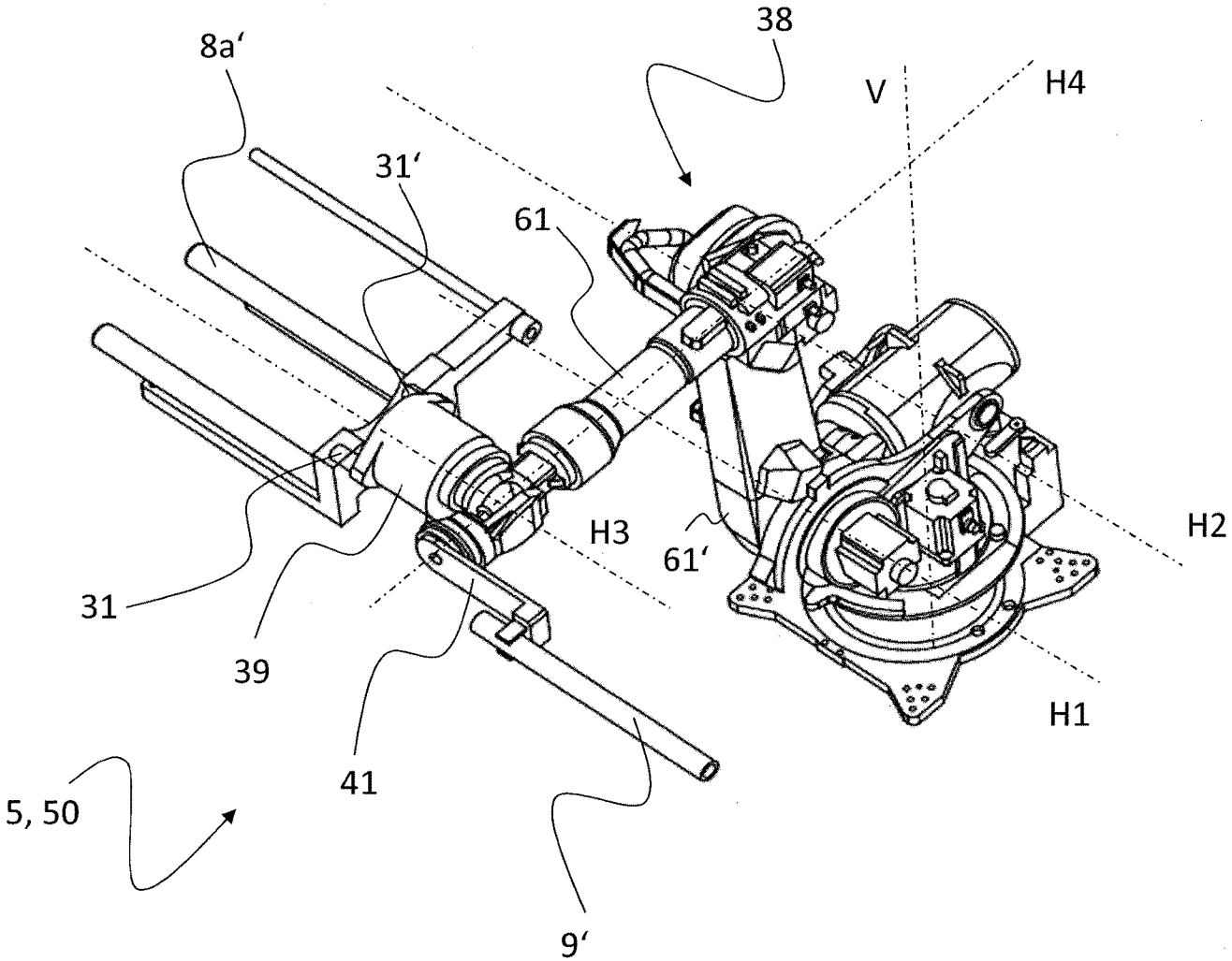
FIG. 6 shows in detail a handling device, as it can be used for diverse embodiments of the device according to the present invention.

FIG. 6 shows in detail a handling device 5, as it can be used for diverse embodiments of the device 1 according to the present invention. The handling device 5 is designed analogously to the handling device of the previous FIGS. 1 to 3 as a handling robot 50 and is rotatable about the vertical axis V. Furthermore, the handling device 5 has an arm 38, which can be pivoted completely about the first horizontal axis H1. Furthermore, the arm 38 for enlarging its freedom of movement consists of two segments 61 and 61', which can be pivoted counter to each other about the second horizontal axis H2. A gripping head 39 as well as a gripper hand 41 are arranged on the free end of the arm 38. The gripping head 39 is designed for receiving removable carrier units 8*a* and 8*b* as well as removable carrier units 8*a'* and 8*b'* and for this purpose comprises several gripper fingers 31 and 31', which when receiving the respective removable carrier unit 8*a* and 8*b* or the respective removable carrier unit 8*a'* or 8*b'* dip into bore holes 25 and 25' (see FIG. 4).

In addition, as can be seen in FIG. 6, the gripping head 39 of the handling device 5 is designed rotatable about a third horizontal axis H3, which runs parallel to the first horizontal axis H1 as well as parallel to the second horizontal axis H2.

In addition, a gripper hand 41 is arranged on its free end 38, which is provided for the receipt of used up supply rolls 9' from the respective installation position EB1 or EB2. The gripper hand 41 is also designed rotatable about a fourth horizontal axis H4. The fourth horizontal axis H4 runs perpendicular to the third horizontal axis H3.

By means of the handling device 5 depicted by way of example in FIG. 6 or by means of the handling device 5 depicted by way of example in FIG. 6, a receipt of removable carrier units 8*a* and 8*b* is made possible with subsequent insertion into the respective installation position EB1 or EB2, without the removable carrier units 8*a* and 8*b* having to rotate for this purpose.

The invention was described by reference to a preferred embodiment. However, it is conceivable for a person skilled in the art, that variations or modifications of the invention can be made, without thereby departing from the scope of the following claims.

LIST OF REFERENCE SIGNS

1 device
3 packaging machine
4 feeding device
5 handling device
6 discharge device
8*a* first removable carrier unit
8*b* second removable carrier unit
8*a'* first removable carrier unit
8*b* second removable carrier unit
9 supply roll
9' used up supply roll
10 flat packaging material
11 packaging film
12 support rod
13 storage module
15 holding mandrel
17 equipment section
19 supporting bar
20 guide element
21 preparatory instrument
23 actuating element
25 bore holes
27 main pillars
29 guide element
31 gripper finger
33 block

35 wheel
38 arm
39 gripping head
40 horizontal conveyor
41 gripper hand
50 handling robot
60 horizontal conveyor
61 segment
AB work area
EB1 first installation position
EB2 second installation position
H axis
S control unit
TR1 transport direction of the feeding device
TR2 transport direction of the discharge device
V axis

The invention claimed is:

1. A system for changing removable carrier units (8*a*', 8*b*') with flat packaging material (10) wound on supply rolls (9) within a packaging machine (3), which is equipped with devices for at least partially wrapping articles with packaging material (10, 10') with a feeding device (4) for the provision of removable carrier units (8*a*, 8*b*) carrying new supply rolls (9) in a series one after the other, which is assigned to a work area (AB) of a handling device (5), which extends into at least one position of the operating position of the removable carrier unit (8*a*', 8*b*') equipped with a supply roll (9) which is arranged in the packaging machine (3), so that removable carrier units (8*a*', 8*b*') located in the packaging machine (3) with used up supply rolls (9') can be replaced with new removable carrier units (8*a*, 8*b*) with new supply rolls (9) by the handling device (5), the packaging machine (3) including at least two different installation positions (EB1, EB2) and a corresponding holding mandrel (15, 15') at each of the at least two different installation positions (EB1, EB2), wherein each of the holding mandrels (15, 15') are aligned to connect with a respective new supply roll (9) when the removable carrier unit (8*a*, 8*b*) carrying the respective new supply roll (9) is inserted into the corresponding installation position (EB1, EB2), wherein the handling device (5) is configured to alternatively insert the respective new removable carrier units (8*a*, 8*b*) with the respective new supply roll (9) at the at least two different installation positions (EB1, EB2) in the packaging machine (3) such that the flat packaging material (10) of the respective new supply roll (9) can be connected with the packaging material (10') still located in the packaging machine (3).

2. The system according to claim 1, in which the removable carrier units (8*a*, 8*b*) with new supply rolls (9) are respectively prepared for the at least two different installation positions (EB1, EB2) in the packaging machine (3) at the latest upon entry into the work area (AB) of the handling device (5).

3. The system according to claim 1, in which the removable carrier units (8*a*, 8*b*) are respectively formed by cassettes having a frame which is designed for the supportive holding of the respective new supply roll (9) with its flat packaging material (10).

4. The system according to claim 3, in which the cassettes in each case have a supporting bar (19, 19') extending parallel to the supply roll, which, before connecting with the packaging material (10') located in the packaging machine, carries a beginning of the flat packaging material (10) wound on the new supply roll (9) of the respective cassette.

5. The system according to claim 4, in which the supporting bars (19, 19') of the cassettes are designed rotatable, so that flat packaging material (10) of the respective new supply roll (9) can be wound on the supporting bar (19, 19') of the respective cassette.

6. The system according to claim 3, wherein the packaging machine (3) has at least one first installation position (EB1) for first removable carrier units (8*a*) and at least one second installation position (EB2) for second removable carrier units (8*b*), which supporting bars (19, 19') of the first removable carrier units (8*a*) and the second removable carrier units (8*b*) are arranged on opposite sides, so that the supporting bars (19) of the first removable carrier units (8*a*) point in the direction of the second installation position (EB2) when inserted into the first installation position (EB1) and the supporting bars (19') of the second removable carrier units (8*b*) point in the direction of the first installation position (EB1) when inserted into the second installation position (EB2).

7. The system according to claim 1, wherein each holding mandrel (15, 15') is designed to enlarge its cross-sectional diameter, so that by enlarging the cross-sectional diameter, the respective supply roll (9) can be fixed by clamping to the holding mandrel (15, 15').

8. The system according to claim 1, in which the handling device (5) is formed by a multiaxially movable handling robot (50), which both inserts new removable carrier units (8*a*, 8*b*) into the packaging machine (3) as well as removes removable carrier units (8*a*', 8*b*') and used up supply rolls (9') from it.

9. The system according to claim 1, comprising a discharge device (6) for removable carrier units (8*a*', 8*b*') removed by the handling device (5) from the packaging machine, wherein the discharge device (6) and the feeding device (4) are respectively formed by one or several horizontal conveyors (60, 40).

10. The system according to claim 1, wherein each removable carrier unit (8*a*, 8*b*) carries its corresponding new supply role (9) such that, when the supply role (9) is connected with the holding mandrel of the machine (3), the supply role (9) disengages contact with its removable carrier unit (8*a*, 8*b*) as the packaging material (1) is unwound.

* * * * *